US006922613B2

(12) United States Patent
Park et al.

(10) Patent No.: US 6,922,613 B2
(45) Date of Patent: Jul. 26, 2005

(54) METHOD FOR OPERATING MULTI-TYPE AIR CONDITIONER

(75) Inventors: Jong Han Park, Gwangmyeong-si (KR); Young Min Park, Incheon-si (KR); Chang Seon Lee, Seoul (KR); Sung Oh Choi, Gwangmyeong-si (KR); Sung Chun Kim, Seoul (KR); Seung Yong Chang, Seoul (KR); Seok Ho Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/728,958

(22) Filed: Dec. 8, 2003

(65) Prior Publication Data

US 2004/0138784 A1 Jul. 15, 2004

(30) Foreign Application Priority Data

Jan. 13, 2003 (KR) ..... 10-2003-0002034

(51) Int. Cl.[7] ..... G05B 13/00
(52) U.S. Cl. ..... 700/276; 700/277
(58) Field of Search ..... 700/276–277; 62/159–160; 236/1 C

(56) References Cited

U.S. PATENT DOCUMENTS

| | | | | |
|---|---|---|---|---|
| 4,987,747 A | | 1/1991 | Nakamura et al. | |
| 5,009,078 A | | 4/1991 | Ohkoshi et al. | 62/160 |
| 5,050,396 A | * | 9/1991 | Ohkoshi et al. | 62/160 |
| 5,107,684 A | | 4/1992 | Nakayama et al. | 62/81 |
| 6,109,533 A | * | 8/2000 | Ao et al. | 237/2 B |
| 2003/0131541 A1 | | 7/2003 | Lee et al. | 52/79.1 |
| 2003/0217557 A1 | | 11/2003 | So et al. | 62/175 |

FOREIGN PATENT DOCUMENTS

| | | |
|---|---|---|
| EP | 0514086 | 11/1992 |
| JP | 5-118625 | 5/1993 |
| JP | 9-14790 | 1/1997 |
| KR | 1992-8504 | 9/1992 |

OTHER PUBLICATIONS

English Language Abstract of JP 9–14790.
English Language Abstract of JP 5–118625.

* cited by examiner

*Primary Examiner*—Anthony Knight
*Assistant Examiner*—Ronald D Hartman, Jr.
(74) *Attorney, Agent, or Firm*—Greenblum & Bernstein, P.L.C.

(57) ABSTRACT

Method for operating a multi-type air conditioner including the steps of calculating a total heating load of the indoor units that are to carry out heating, and a total cooling load of the indoor units that are to carry out cooling, and determining an operation pattern of the outdoor unit according to the total cooling load and the total heating load. The method further including the steps of recalculating the total heating load and the total cooling load of the indoor units according to change of operation temperature of the indoor units, and changing the operation pattern of the outdoor units according to the recalculated total heating load and the total cooling load.

17 Claims, 7 Drawing Sheets

METHOD FOR OPERATING MULTI-TYPE AIR CONDITIONER

This application claims the benefit of the Korean Application No. P2003-0002034 filed on Jan. 13, 2003, which is hereby incorporated by reference.

BACKGROUND OF THE INVENTION

1. Field of the Invention

The present invention relates to multi-type air conditioners, and more particularly, to a method for operating a multi-type air conditioner, in which an operation pattern of the outdoor unit is determined, efficiently.

2. Background of the Related Art

In general, the air conditioner is an appliance for cooling or heating spaces, such as living spaces, restaurants, and offices. At present, for effective cooling or heating of a space partitioned into many rooms, there has been ceaseless development of multi-type air conditioner for cooling or heating, or cooling and heating at the same time depending on operation conditions.

The multi-type air conditioner is in general provided with one outdoor unit having an outdoor heat exchanger for heat exchange between refrigerant and external air and a plurality of indoor units each connected to the outdoor unit. The operation pattern of the outdoor unit is dependent on operation patterns of indoor units which heat or cool the rooms.

A related art method for operating a multi-type air conditioner will be described, in which the operation pattern of the outdoor unit is dependent on the operation patterns of respective indoor units. First, when the indoor units only cool the rooms, the outdoor unit carries out a cooling operation, when the outdoor heat exchanger serves as a condenser. When the indoor units only heat the rooms, the outdoor unit carries out a heating operation, when the outdoor heat exchanger serves as an evaporator.

When some of the indoor units cool respective rooms, and, at the same time with this, rest of the indoor units heat respective rooms, a number of the indoor unit that cool the rooms and a number of the indoor unit that heat the rooms are compared, so that the outdoor unit carries out the cooling operation when the number of indoor units that cool the rooms is greater than the number of the indoor unit that heat the rooms, and vice versa.

However, the related art method for operating a multi-type air conditioner has the following problems. When the indoor units cool or heat the rooms respectively at the same time, there has been a problem of varying the operation pattern of the outdoor unit in the middle of operation because the operation pattern of the outdoor unit is determined simply based on comparison of numbers of indoor units that cool/heat rooms without determining a load required for operation of the indoor units, actually.

That is, even if the number of indoor unit that heat the rooms is greater than the number of indoor units that cool the rooms, if the indoor units require a heavier load in cooling, the outdoor unit requires to carry out cooling operation. However, in the related art operation method, the outdoor unit carries out heating operation, to cause to vary the operation pattern of the outdoor unit in the middle of the operation.

The variation of the operation pattern in the middle of operation causes waste of energy coming from a pressure loss, and failure in smooth operation of the cooling/heating.

SUMMARY OF THE INVENTION

Accordingly, the present invention is directed to a method for operating a multi-type air conditioner that substantially obviates one or more of the problems due to limitations and disadvantages of the related art.

An object of the present invention is to provide a method for operating a multi-type air conditioner, in which operation patterns of indoor units are determined efficiently, for prevention of waste of energy caused by a pressure loss, and carrying out smooth cooling/heating.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the method for operating a multi-type air conditioner includes the steps of calculating a total heating load of the indoor units that are to carry out heating, and a total cooling load of the indoor units that are to carry out cooling, and determining an operation pattern of the outdoor unit according to the total cooling load and the total heating load.

The total cooling load of the indoor units is $Qc1\times(Tcr1-Tcs1)+Qc2\times(Tcr2-Tcs2)+Qc3\times(Tcr3-Tcs3)+\cdots$, where Qc1, Qc2, Qc3, - - - denote capacities of the indoor unit that are to carry out cooling, Tcs1, Tcs2, Tcs3, - - - denote operation temperatures of the indoor units, and Tcr1, Tcr2, Tcr3, - - - denote room temperatures of respective rooms, and the total heating load of the indoor units is $Qh1\times(Ths1-Thr1)+Qh2\times(Ths2-Thr2)+Qh3\times(Ths3-Thr3)+\cdots$, where Qh1, Qh2, Qh3, - - - denote capacities of the indoor unit that are to carry out heating, Ths1, Ths2, Ths3, - - - denote operation temperatures of the indoor units, and Thr1, Thr2, Thr3, - - - denote room temperatures of respective rooms.

The step of determining an operation pattern of the outdoor unit includes the steps of comparing the total heating load and the total cooling load of the indoor units, and the outdoor unit carrying out heating if the total heating load is greater than the total cooling load, and the outdoor unit carrying out cooling if the total heating load is smaller than the total cooling load.

The step of determining an operation pattern of the outdoor unit further includes the steps of comparing the outdoor temperature to a preset reference temperature if the total heating load is equal to the total cooling load, and the outdoor unit carrying out cooling if the outdoor temperature exceeds the reference temperature, and the outdoor unit carrying out heating if the outdoor temperature is below the reference temperature. The reference temperature is 15° C.

The method further includes the steps of recalculating the total heating load and the total cooling load of the indoor units following operation temperature change of the indoor units, and changing an operation pattern of the outdoor unit according to the recalculated total heating load and total cooling load.

The recalculated total cooling load of the indoor units is $Qc1\times(Tcr1-Tcm1)+Qc2\times(Tcr2-Tcm2)+Qc3\times(Tcr3-Tcm3)+\cdots$, where Qc1, Qc2, Qc3, - - - denote capacities of the indoor units that are to carry out cooling, Tcm1, Tcm2, Tcm3, - - - denote changed operation temperatures of the indoor units, and Tcr1, Tcr2, Tcr3, - - - denote room temperatures of respective rooms, and the recalculated total heating load of the indoor units is $Qh1\times(Thm1-Thr1)+Qh2\times(Thm2-Thr2)+Qh3\times(Thm3-Thr3)+\cdots$, where Qh1, Qh2, Qh3, - - - denote capacities of the indoor units that are to carry out heating, Thm1, Thm2, Thm3, - - - denote changed operation temperatures of the indoor units, and Thr1, Thr2, Thr3, - - - denote room temperatures of respective rooms.

The step of changing an operation pattern of the outdoor unit includes the steps of comparing the recalculated total cooling load and the recalculated total heating load, and the outdoor unit carrying out heating if the total heating load is greater than the total cooling load, and the outdoor unit carrying out cooling if the total heating load is smaller than the total cooling load.

The step of changing an operation pattern of the outdoor unit further includes the steps of comparing the outdoor temperature to a preset reference temperature if the total heating load is equal to the total cooling load, and the outdoor unit carrying out cooling if the outdoor temperature exceeds the reference temperature, and the outdoor unit carrying out heating if the outdoor temperature is below the reference temperature. Preferably, the reference temperature is 15° C.

The method further includes the steps of recalculating the total heating load or the total cooling load of the indoor units if the operation temperature of the indoor units is changed, and changing the operation pattern of the outdoor unit according to the recalculated total heating load and the recalculated total cooling load of the indoor units.

The step of recalculating the total heating load or the total cooling load of the indoor units includes the steps of determining the operation pattern of the outdoor unit, and only recalculating the total cooling load of the indoor units if the operation pattern of the outdoor unit is cooling, and only recalculating the total heating load of the indoor units if the operation pattern of the outdoor unit is heating.

The step of changing an operation pattern of the outdoor unit includes the steps of comparing the recalculated total cooling/heating loads to the total cooling/heating loads before change of the operation temperature, the outdoor unit continuing to carry out cooling if the recalculated total cooling load is greater than the total heating load before change of the operation temperature, and the outdoor unit carrying out heating if the recalculated total cooling load is smaller than the total heating load before change of the operation temperature, and the outdoor unit continuing to carry out heating if the recalculated total heating load is greater than the total cooling load before change of the operation temperature, and the outdoor unit carrying out cooling if the recalculated total heating load is smaller than the total cooling load before change of the operation temperature.

The step of changing an operation pattern of the outdoor unit further includes the steps of comparing the outdoor temperature to a preset reference temperature if the recalculated total cooling load is equal to the total heating load of the indoor units before change of the operation temperature, or if the recalculated total heating load is equal to the total cooling load of the indoor units before change of the operation temperature, and the outdoor unit carrying out cooling if the outdoor temperature exceeds the reference temperature, and the outdoor unit carrying out heating if the outdoor temperature is below the reference temperature. The reference temperature is 15° C.

The recalculated total cooling load is calculated by adding the total cooling load of the indoor units before change of the operation temperature and an additional cooling load required following change of the operation temperature, and the recalculated total heating load is calculated by adding the total heating load of the indoor units before change of the operation temperature and an additional heating load required following change of the operation temperature.

The additional cooling load of the indoor units is $Qc1\times(Tcs1-Tcm1)+Qc2\times(Tcs2-Tcm2)+Qc3\times(Tcs3-Tcm3)+ - - -$, where Qc1, Qc2, Qc3, - - - denote capacities of the indoor unit that are to carry out cooling, Tcm1, Tcm2, Tcm3, - - - denote operation temperatures of the indoor units that are to carry out cooling after change, and Tcs1, Tcs2, Tcs3, - - - denote operation temperatures of the indoor units before the change, and the additional heating load of the indoor units is $Qh1\times(Thm1-Ths1)+Qh2\times(Thm2-Ths2)+Qh3\times(Thm3-Ths3)+ - - -$, where Qh1, Qh2, Qh3, - - - denote capacities of the indoor unit that are to carry out heating, Thm1, Thm2, Thm3, - - - denote operation temperatures of the indoor units that are to heat the rooms after change, and Ths1, Ths2, Ths3, - - - denote room temperatures of respective rooms before change.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing embodiments of the present invention, same parts with be given the same names and reference symbols, and repetitive description of which will be omitted.

Figure 1:
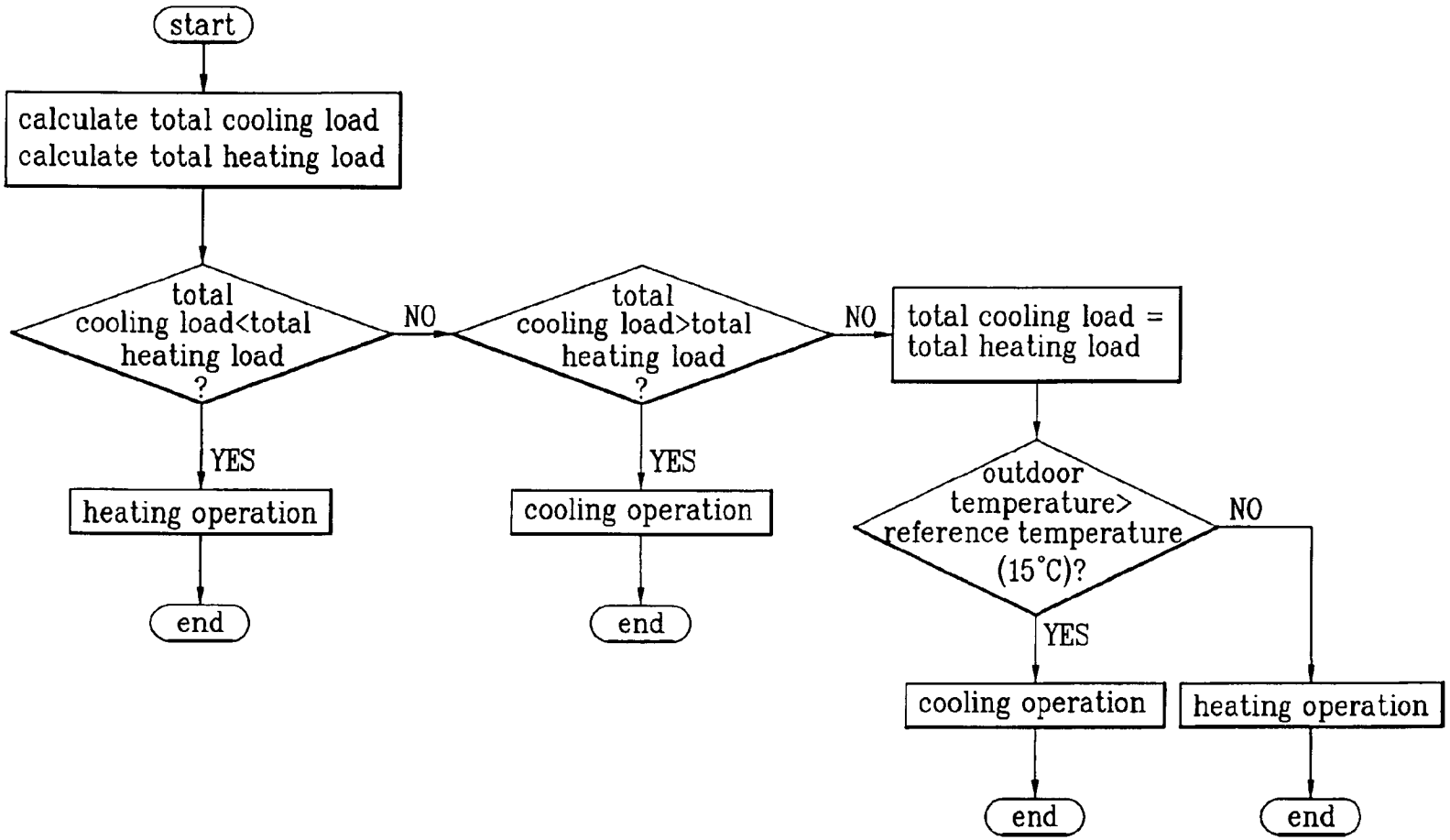
FIG. 1 illustrates a flow chart showing the steps of a method for operating a multi-type air conditioner in accordance with a first preferred embodiment of the present invention.
Figure 2:
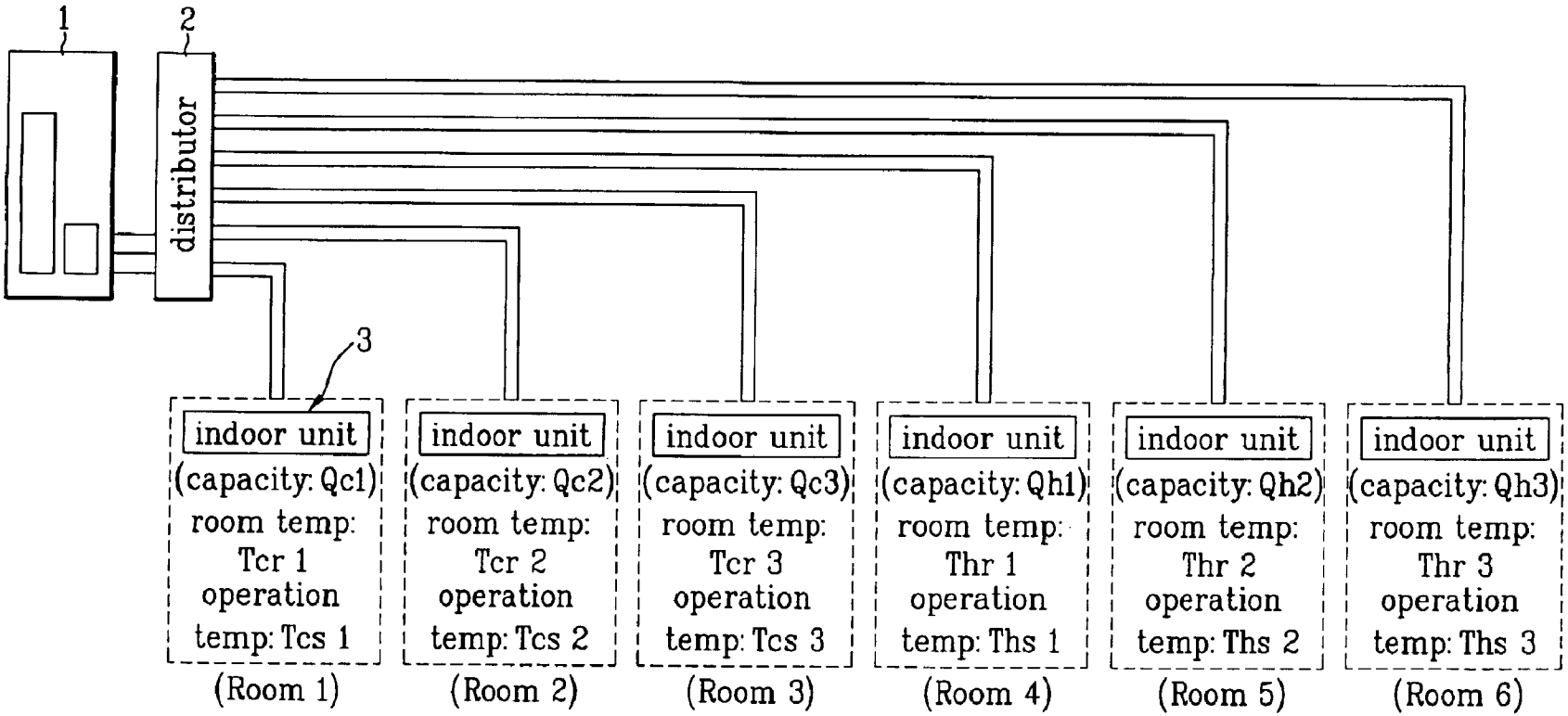
FIG. 2 illustrates a method for calculating a total cooling load and a total heating load of indoor units in accordance with a first preferred embodiment of the present invention.

FIG. 1 illustrates a flow chart showing the steps of a method for operating a multi-type air conditioner in accordance with a first preferred embodiment of the present invention, and FIG. 2 illustrates a method for calculating a total cooling load and a total heating load of indoor units in accordance with a first preferred embodiment of the present invention. Referring to FIGS. 1 and 2, the multi-type air conditioner of the present invention having an outdoor unit 1, a distributor 2, and a plurality of indoor units 3 determines an operation pattern of the outdoor unit 1 according to total cooling/heating loads of the indoor units 3.

The total heating load is a sum of heating loads of the indoor units 3 that are to carry out heating, and the total cooling load is a sum of cooling loads of the indoor units 3 that are to carry out cooling. Thus, the total cooling/heating loads are calculated before starting operation of the multi-type air conditioner.

A method for calculating the total cooling/heating loads will be described in more detail with reference to FIG. 2. Though only three indoor units that carry out cooling, and only three indoor units that carry out heating are shown in respective drawings, a number of the indoor units that carry out the cooling/heating operations are not limited to this.

The total cooling load of the indoor units 3 is calculated like $Qc1\times(Tcr1-Tcs1)+Qc2\times(Tcr2-Tcs2)+Qc3\times(Tcr3-Tcs3)+\cdots$, where Qc1, Qc2, Qc3, - - - denote capacities of the indoor unit 3 that are to carry out cooling. The Tcs1, Tcs2, Tcs3, - - - denote operation temperatures of the indoor units 3, and Tcr1, Tcr2, Tcr3, - - - denote room temperatures of respective rooms.

The total heating load of the indoor units 3 is calculated like $Qh1\times(Ths1-Thr1)+Qh2\times(Ths2-Thr2)+Qh3\times(Ths3-Thr3)+\cdots$, where Qh1, Qh2, Qh3, - - - denote capacities of the indoor unit 3 that are to carry out heating. The Ths1, Ths2, Ths3, - - - denote operation temperatures of the indoor units 3, and Thr1, Thr2, Thr3, - - - denote room temperatures of respective rooms. Above calculations are in general carried out with a microcomputer (not shown).

Then, the total heating load and the total cooling load are compared. If the total heating load is greater than the total cooling load, the outdoor unit 1 carries out heating operation, and vice versa.

If the total heating load and the total cooling load are equal, an outdoor temperature is compared to a preset reference temperature. If the outdoor temperature exceeds the reference temperature, the outdoor unit 1 carries out cooling operation, and vice versa.

The reference temperature, preset in the microcomputer or the like in the multi-type air conditioner, may be changed by an operator. Most preferably, the reference temperature is 15° C. That is, if the outdoor temperature exceeds 15° C., which is near to summer, the outdoor unit 1 carries out cooling operation, and if the outdoor temperature is below 15° C., which is near to winter, the outdoor unit 1 carries out heating operation.

Figure 3:
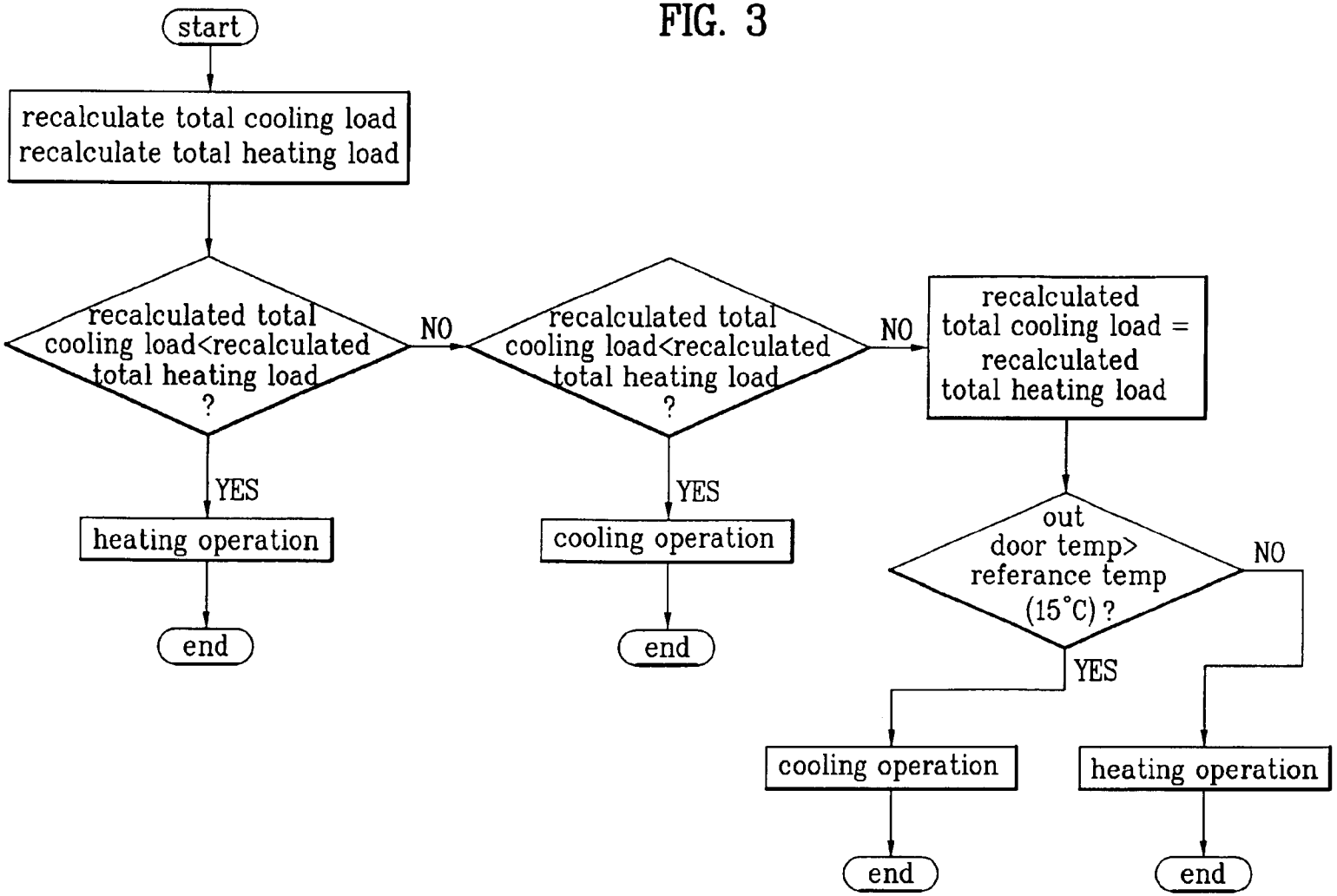
FIG. 3 illustrates a flow chart showing the steps of a method for operating a multi-type air conditioner in accordance with a second preferred embodiment of the present invention.
Figure 4:
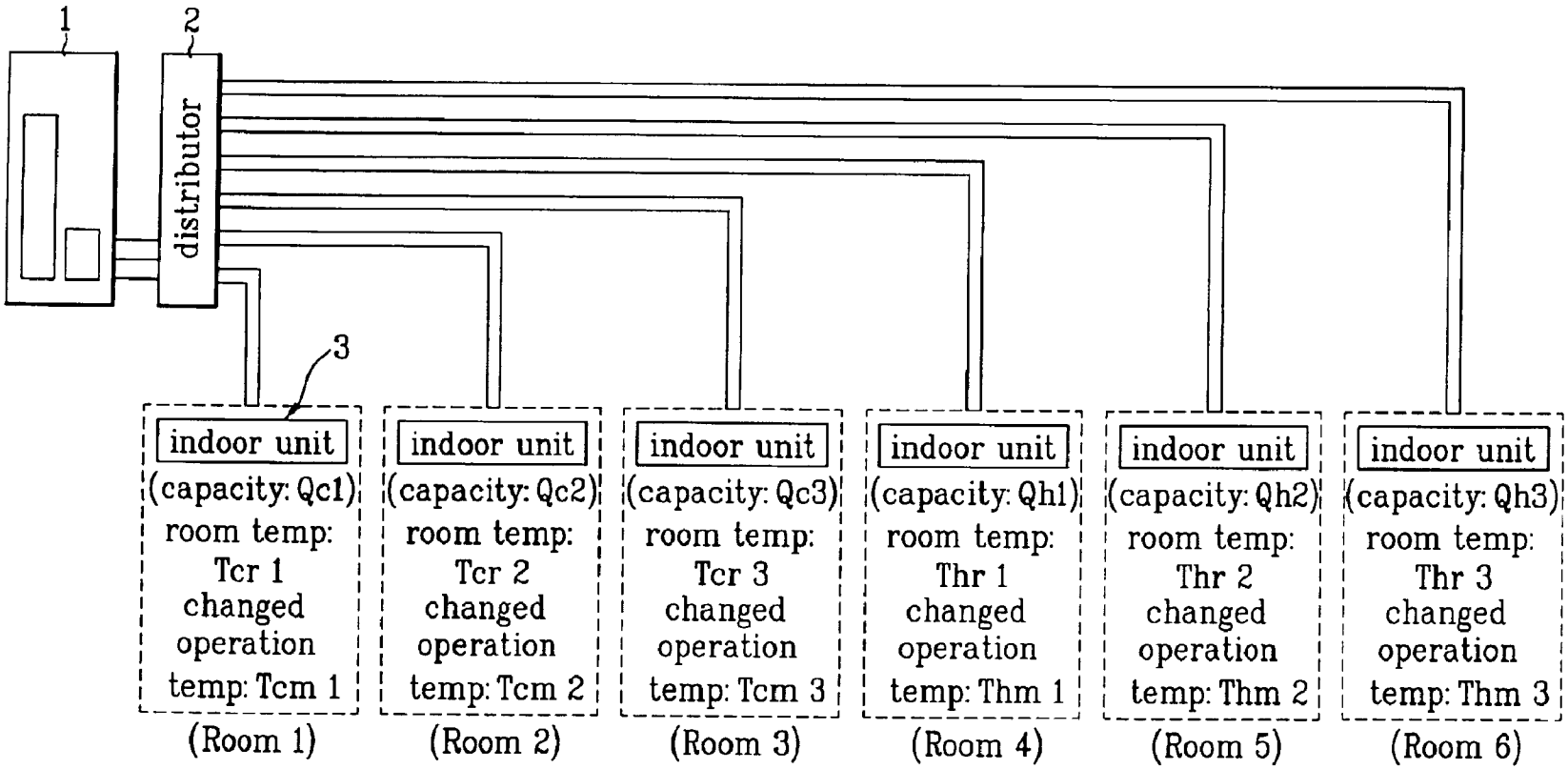
FIG. 4 illustrates a method for calculating a total cooling load and a total heating load of indoor units in accordance with a second preferred embodiment of the present invention.

FIG. 3 illustrates a flow chart showing the steps of a method for operating a multi-type air conditioner in accordance with a second preferred embodiment of the present invention, and FIG. 4 illustrates a method for calculating a total cooling load and a total heating load of indoor units in accordance with a second preferred embodiment of the present invention. Referring to FIG. 3, the multi-type air conditioner in accordance with second preferred embodiment of the present invention recalculates total cooling/heating loads of the indoor units 3 when an operation temperature of the indoor units 3 is changed by the user, for determining an operation pattern of the outdoor unit 1.

A method for recalculating the total cooling/heating loads will be described in more detail with reference to FIG. 4. The total cooling load of the indoor units 3 is recalculated like $Qc1\times(Tcr1-Tcm1)+Qc2\times(Tcr2-Tcm2)+Qc3\times(Tcr3-Tcm3)+\cdots$, where Qc1, Qc2, Qc3, - - - denote capacities of the indoor unit 3 that are to carry out cooling. The Tcm1, Tcm2, Tcm3, - - - denote changed operation temperatures of the indoor units 3, and Tcr1, Tcr2, Tcr3, - - - denote room temperatures of respective rooms.

The total heating load of the indoor units 3 is recalculated like $Qh1\times(Thm1-Thr1)+Qh2\times(Thm2-Thr2)+Qh3\times(Thm3-Thr3)+\cdots$, where Qh1, Qh2, Qh3, - - - denote capacities of the indoor unit 3 that are to carry out heating. The Thm1, Thm2, Thm3, - - - denote changed operation temperatures of the indoor units 3, and Thr1, Thr2, Thr3, - - - denote room temperatures of respective rooms.

Then, the recalculated total heating load and the recalculated total cooling load are compared. If the total heating load is greater than the total cooling load, the outdoor unit 1 carries out heating operation, and vice versa.

If the total heating load and the total cooling load are equal, an outdoor temperature is compared to a preset reference temperature. If the outdoor temperature exceeds the reference temperature, the outdoor unit 1 carries out cooling operation, and vice versa. As described before, the reference temperature is, preferably, is 15° C.

Figure 5:
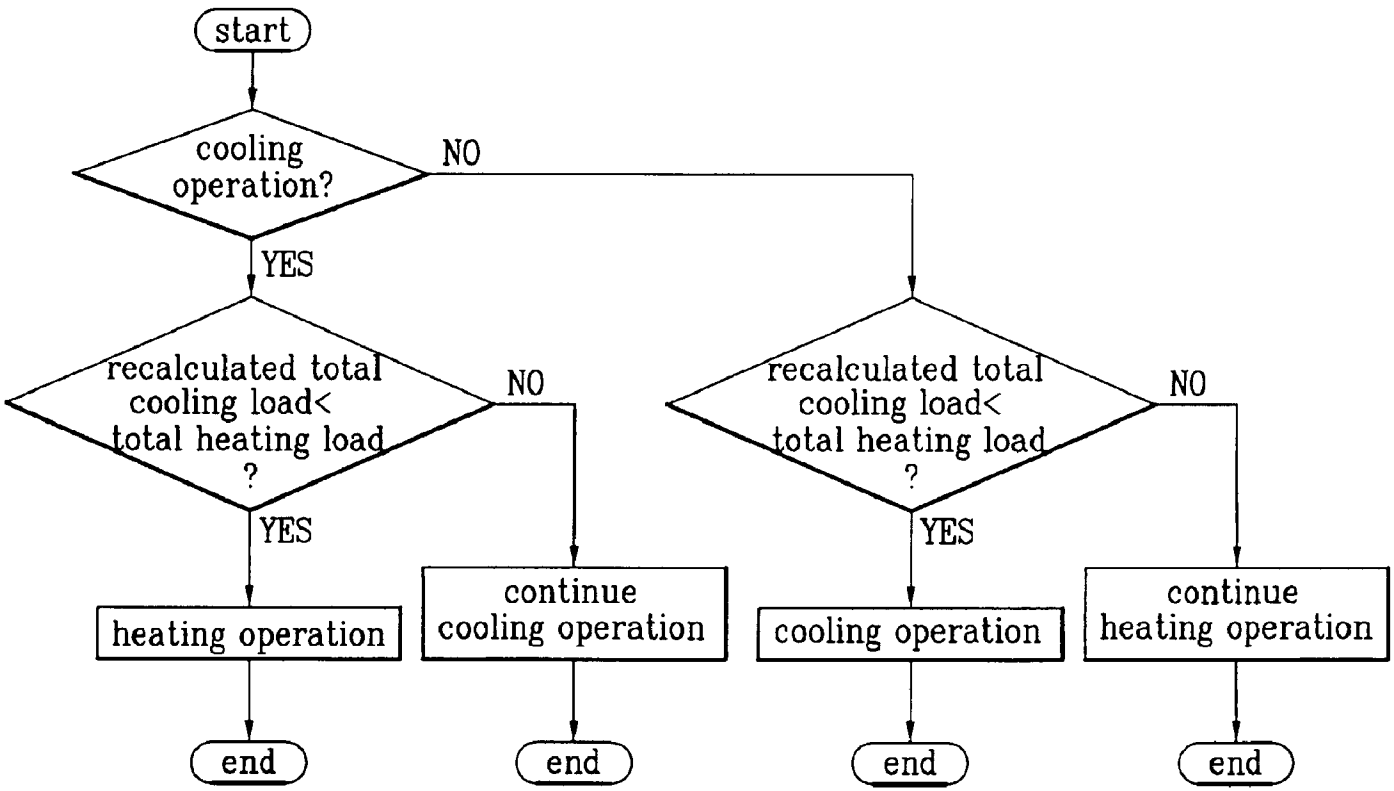
FIG. 5 illustrates a flow chart showing the steps of a method for operating a multi-type air conditioner in accordance with a third preferred embodiment of the present invention.

FIG. 5 illustrates a flow chart showing the steps of a method for operating a multi-type air conditioner in accordance with a third preferred embodiment of the present invention. Referring to FIG. 5, the multi-type air conditioner in accordance with third preferred embodiment of the present invention recalculates a total cooling load or a total heating load of the indoor units 3 when an operation temperature of the indoor units 3 is changed by the user, for determining an operation pattern of the outdoor unit 1.

The recalculation of the total cooling load or the total heating load is made after determining the operation pattern of the outdoor unit 1. That is, if the operation pattern of the outdoor unit 1 is the cooling operation, only the total cooling load of the indoor unit 3 is recalculated, and if the operation pattern of the outdoor unit 1 is the heating operation, only the total heating load of the indoor unit 3 is recalculated.

The only calculation of the total cooling load or the total heating load depending on the operation pattern of the outdoor unit 1 permits to determine the operation pattern of the indoor units 3, more conveniently. The method for calculating the total cooling/heating load is identical to the method described in the second embodiment.

Then, the recalculated total cooling/heating load and the total cooling/heating load of the indoor units 3 before change of the operation temperature are compared, for determining the operation pattern of the outdoor unit 1. In this instance, if the recalculated total cooling load is greater than the total heating load of the indoor units 3 before change of the operation temperature, the outdoor unit 1 continues to carry out cooling operation, and if the recalculated total cooling load is smaller than the total heating load of the indoor units 3 before change of the operation temperature, the outdoor unit 1 carries out heating operation. If the recalculated total heating load is greater than the total cooling load of the indoor units 3 before change of the operation temperature, the outdoor unit 1 carries out heating operation, and if the recalculated total heating load is smaller than the total cooling load of the indoor units 3 before change of the operation temperature, the outdoor unit 1 carries out cooling operation.

If the recalculated total cooling load is equal to the total heating load of the indoor units 3 before change of the operation temperature, or if the recalculated total heating load is equal to the total cooling load of the indoor units 3 before change of the operation temperature, it is preferable that the outdoor temperature is compared to a preset reference temperature. In this instance, if the outdoor temperature exceeds the reference temperature, the outdoor unit 1 carries out cooling operation, and vice versa. Of course, the reference temperature is, preferably, is 15° C.

Figure 6:
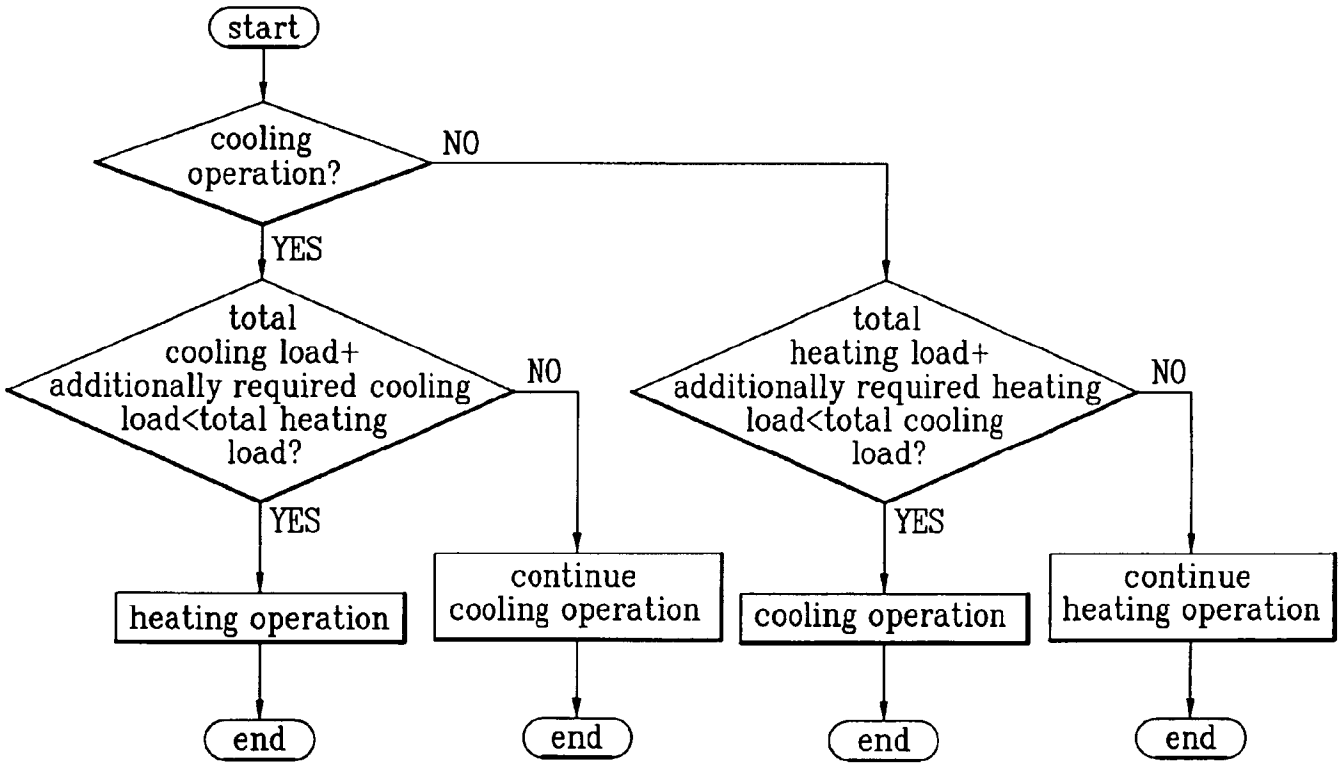
FIG. 6 illustrates a flow chart showing the steps of a method for operating a multi-type air conditioner in accordance with a fourth preferred embodiment of the present invention.
Figure 7:
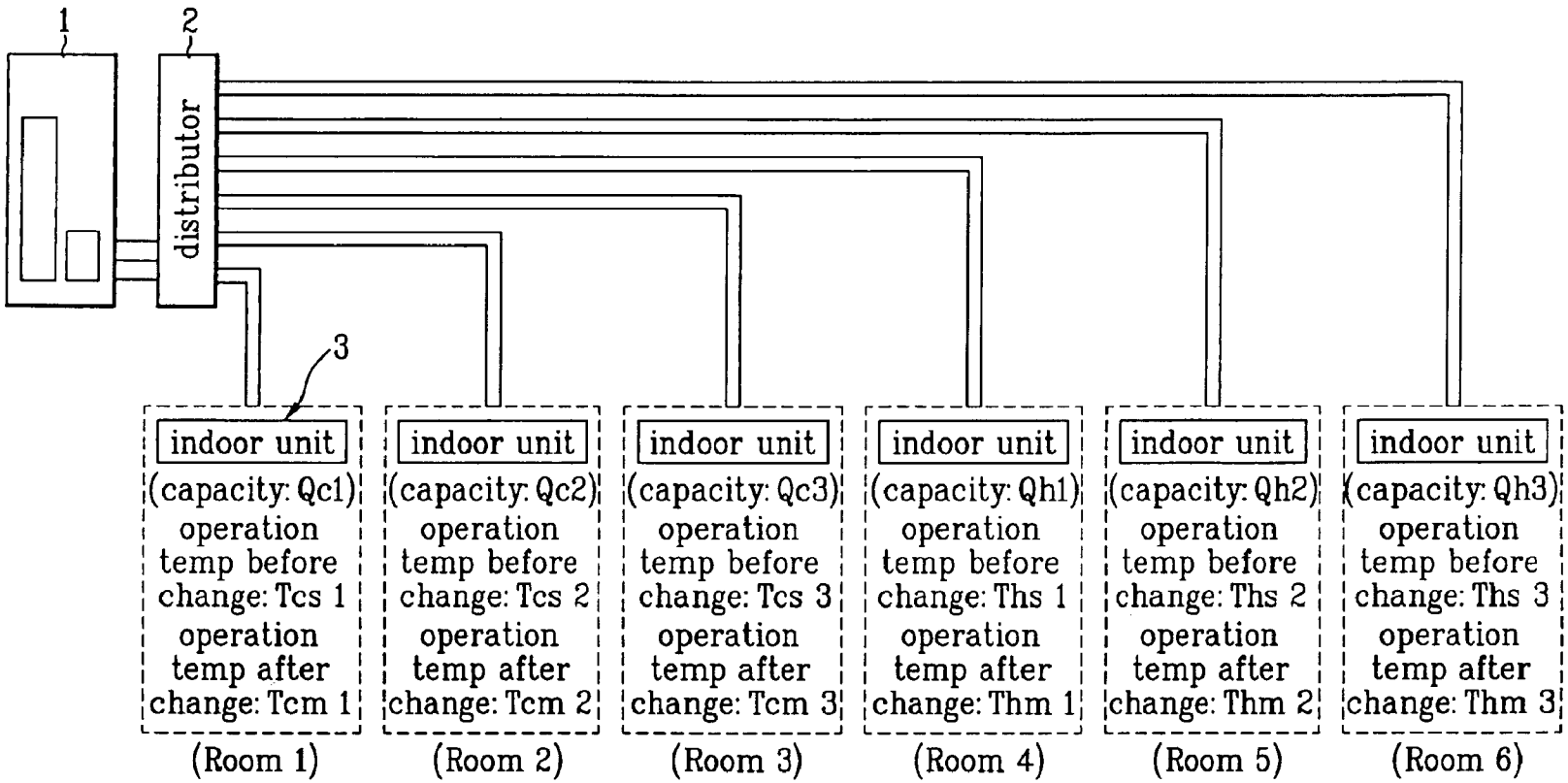
FIG. 7 illustrates a method for calculating a total cooling load and a total heating load of indoor units in accordance with a fourth preferred embodiment of the present invention.

FIG. 6 illustrates a flow chart showing the steps of a method for operating a multi-type air conditioner in accordance with a fourth preferred embodiment of the present invention, and FIG. 7 illustrates a method for calculating a total cooling load and a total heating load of indoor units in accordance with a fourth preferred embodiment of the present invention. Referring to FIG. 6, the multi-type air conditioner in accordance with fourth preferred embodiment of the present invention only calculates cooling/heating loads of the indoor units 3 required additionally following the change of operation temperature of the indoor units 3 for recalculation of the total cooling load or the total heating load of the indoor units 3.

That is, the total cooling load is calculated by adding the total cooling load of the indoor units 3 before change of the operation temperature and a cooling load of the indoor units 3 required additionally following the change of the operation temperature, and the total heating load is calculated by adding the total heating load of the indoor units 3 before change of the operation temperature and a heating load of the indoor units 3 required additionally following the change of the operation temperature.

A method for calculating the additional cooling/heating loads of the indoor units 3 will be described in more detail with reference to FIG. 7.

The additional cooling load of the indoor units 3 is calculated like $Qc1\times(Tcs1-Tcm1)+Qc2\times(Tcs2-Tcm2)+Qc3\times(Tcs3-Tcm3)+\cdots$, where Qc1, Qc2, Qc3, - - - denote capacities of the indoor unit 3 that are to carry out cooling. The Tcm1, Tcm2, Tcm3, - - - denote operation temperatures of the indoor units 3 that are to carry out cooling after change, and Tcs1, Tcs2, Tcs3, - - - denote operation temperatures of the indoor units before change.

The additional heating load of the indoor units 3 is calculated like $Qh1\times(Thm1-Ths1)+Qh2\times(Thm2-Ths2)+Qh3\times(Thm3-Ths3)+\cdots$, where Qh1, Qh2, Qh3, - - - denote capacities of the indoor unit 3 that are to carry out heating. The Thm1, Thm2, Thm3, - - - denote operation temperatures of the indoor units 3 that are to heat the rooms after change, and Ths1, Ths2, Ths3, - - - denote room temperatures of respective rooms before change.

Then, the recalculated total cooling/heating loads and the total cooling/heating loads of the indoor units before change of the operation temperature are compared, for determining the operation pattern of the outdoor unit 1. Since the method for determining the operation pattern is identical to the third embodiment, description of which will be omitted.

As has been described, the method for operating a multi-type air conditioner of the present invention has the following advantages.

In the method for operating a multi-type air conditioner of the present invention, a total cooling load and a total heating load are compared for determining an operation pattern. Therefore, the related art problem of varying the operation pattern of the outdoor unit in the middle of operation coming from starting operation without accurate calculation of the total cooling/heating loads can be prevented, thereby permitting smooth cooling/heating and to prevent waste of energy caused by a pressure loss.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method for operating an air conditioner having an outdoor unit, a distributor, and a plurality of indoor units, the method comprising:

calculating a total heating load of the indoor units that are to carry out heating, and a total cooling load of the indoor units that are to carry out cooling;

operating the indoor units according to an operation pattern of the outdoor unit determined by comparing the total cooling load and the total heating load;

recalculating the total heating load and the total cooling load of the indoor units when an operation temperature of the indoor units is changed; and further operating the indoor units according to a changed operation pattern of the outdoor unit associated with the recalculating of the total heating load and the total cooling load of the indoor units, wherein the recalculated total cooling load is calculated by adding the total cooling load of the indoor units before the change of the operation temperature and an additional cooling load required following the change of the operation temperature, and wherein the recalculated total heating load is calculated by adding the total heating load of the indoor units before the change of the operation temperature and an additional heating load required following the change of the operation temperature.

2. The method as recited in claim 1, wherein the total cooling load of the indoor units is $Qc1\times(Tcr1-Tcs1)+Qc2\times(Tcr2-Tcs2)+Qc3\times(Tcr3-Tcs3)+\cdots$, where Qc1, Qc2, Qc3, - - - denote capacities of the indoor units that carry out cooling, Tcs1, Tcs2, Tcs3, - - - denote operation temperatures of the indoor units, and Tcr1, Tcr2, Tcr3, - - - denote room temperatures of respective rooms, and the total heating load of the indoor units is $Qh1\times(Ths1-Thr1)+Qh2\times(Ths2-Thr2)+Qh3\times(Ths3-Thr3)+\cdots$, where Qh1, Qh2, Qh3, - - - denote capacities of the indoor units that carry out heating, Ths1, Ths2, Ths3, - - - denote operation temperatures of the indoor units, and Thr1, Thr2, Thr3, - - - denote room temperatures of respective rooms.

3. The method as recited in claim 1, wherein the operation pattern of the outdoor unit is determined such that the outdoor unit carries out heating when the total heating load is greater than the total cooling load, and the outdoor unit carries out cooling when the total heating load is smaller than the total cooling load.

4. The method as recited in claim 3, wherein the determination of an operation pattern of the outdoor unit further includes comparing an outdoor temperature to a reference temperature when the total heating load is equal to the total cooling load, the outdoor unit carrying out cooling when the outdoor temperature exceeds the reference temperature, and the outdoor unit carrying out heating when the outdoor temperature is below the reference temperature.

5. The method as recited in claim 4, wherein the reference temperature is 15° C.

6. The method as recited in claim 1, wherein the recalculated total cooling load of the indoor units is $Qc1\times(Tcr1-Tcm1)+Qc2\times(Tcr2-Tcm2)+Qc3\times(Tcr3-Tcm3)+\cdots$, where Qc1, Qc2, Qc3, - - - denote capacities of the indoor units that carry out cooling, Tcm1, Tcm2, Tcm3, - - - denote changed operation temperatures of the indoor units, and Tcr1, Tcr2, Tcr3, - - - denote room temperatures of respective rooms, and the recalculated total heating load of the indoor units is $Qh1\times(Thm1-Thr1)+Qh2\times(Thm2-Thr2)+Qh3\times(Thm3-Thr3)+\cdots$, where Qh1, Qh2, Qh3, - - - denote capacities of the indoor units that carry out heating, Thm1, Thm2, Thm3, - - - denote changed operation temperatures of the indoor units, and Thr1, Thr2, Thr3, - - - denote room temperatures of respective rooms.

7. The method as recited in claim 1, wherein the changed operation pattern of the outdoor unit is determined by comparing the recalculated total cooling load and the recalculated total heating load, and the outdoor unit carries out heating when the total heating load is greater than the total cooling load, wherein the outdoor unit carries out cooling when the total heating load is smaller than the total cooling load.

8. The method as recited in claim 7, wherein the changed operation pattern of the outdoor unit is further determined by comparing an outdoor temperature to a reference temperature when the total heating load is equal to the total cooling load, and the outdoor unit carrying out cooling when the outdoor temperature exceeds the reference temperature, and the outdoor unit carrying out heating when the outdoor temperature is below the reference temperature.

9. The method as recited in claim 8, wherein the reference temperature is 15° C.

10. The method as recited in claim 1, wherein the recalculating of the total heating load and the total cooling load of the indoor units includes determining the operation pattern of the outdoor unit, and only recalculating the total cooling load of the indoor units when the operation pattern of the outdoor unit is cooling, and only recalculating the total heating load of the indoor units when the operation pattern of the outdoor unit is heating.

11. The method as recited in claim 10, wherein the recalculated total cooling load of the indoor units is $Qc1\times(Tcr1-Tcm1)+Qc2\times(Tcr2-Tcm2)+Qc3\times(Tcr3-Tcm3)+\cdots$, where Qc1, Qc2, Qc3, - - - denote capacities of the indoor units that carry out cooling, Tcm1, Tcm2, Tcm3, - - - denote changed operation temperatures of the indoor units, and Tcr1, Tcr2, Tcr3, - - - denote room temperatures of respective rooms, and the recalculated total heating load of the indoor units is $Qh1\times(Thm1-Thr1)+Qh2\times(Thm2-Thr2)+Qh3\times(Thm3-Thr3)+\cdots$, where Qh1, Qh2, Qh3, - - - denote capacities of the indoor units that carry out heating, Thm1, Thm2, Thm3, - - - denote changed operation temperatures of the indoor units, and Thr1, Thr2, Thr3, - - - denote room temperatures of respective rooms.

12. The method as recited in claim 10, wherein the operation pattern of the outdoor unit is changed by comparing the recalculated total cooling/heating loads to the total cooling/heating loads before change of the operation temperature, the outdoor unit continuing to carry out cooling when the recalculated total cooling load is greater than the total heating load before change of the operation temperature, and the outdoor unit carrying out heating when the recalculated total cooling load is smaller than the total heating load before change of the operation temperature, and the outdoor unit continuing to carry out heating when the recalculated total heating load is greater than the total cooling load before change of the operation temperature, and the outdoor unit carrying out cooling when the recalculated total heating load is smaller than the total cooling load before change of the operation temperature.

13. The method as recited in claim 12, wherein operation pattern of the outdoor unit is further changed by comparing the outdoor temperature to a reference temperature when the recalculated total cooling load is equal to the total heating load of the indoor units before change of the operation temperature, or when the recalculated total heating load is equal to the total cooling load of the indoor units before change of the operation temperature, and the outdoor unit carrying out cooling when the outdoor temperature exceeds the reference temperature, and the outdoor unit carrying out heating when the outdoor temperature is below the reference temperature.

14. The method as claimed in claim 13, wherein the reference temperature is 15° C.

15. The method as recited in claim 1, wherein the additional cooling load of the indoor units is $Qc1\times(Tcs1-Tcm1)+Qc2\times(Tcs2-Tcm2)+Qc3\times(Tcs3-Tcm3)+\cdots$, where Qc1, Qc2, Qc3, - - - denote capacities of the indoor unit that carry out cooling, Tcm1, Tcm2, Tcm3, - - - denote operation temperatures of the indoor units that carry out cooling after the change of operation temperature, and Tcs1, Tcs2, Tcs3, - - - denote operation temperatures of the indoor units before the change of operation temperature, and the additional heating load of the indoor units is $Qh1\times(Thm1-Ths1)+Qh2\times(Thm2-Ths2)+Qh3\times(Thm3-Ths3)+\cdots$, where Qh1, Qh2, Qh3, - - - denote capacities of the indoor unit that carry out heating, Thm1, Thm2, Thm3, - - - denote operation temperatures of the indoor units that heat the rooms after the change of operation temperature, and Ths1, Ths2, Ths3, - - - denote room temperatures of respective rooms before the change of operation temperature.

16. The method as recited in claim 1, wherein the operation pattern of the outdoor unit is changed by comparing the recalculated total cooling/heating loads to the total cooling/heating loads before the change of operation temperature, the outdoor unit continuing to carry out cooling when the recalculated total cooling load is greater than the total heating load before the change of operation temperature, and the outdoor unit carrying out heating when the recalculated total cooling load is smaller than the total heating load before the change of operation temperature, and the outdoor unit continuing to carry out heating when the recalculated total heating load is greater than the total cooling load before the change of operation temperature, and the outdoor unit carrying out cooling when the recalculated total heating load is smaller than the total cooling load before the change of operation temperature.

17. The method as recited in claim 16, wherein the changing an operation pattern of the outdoor unit further includes comparing the outdoor temperature to a reference temperature when the recalculated total cooling load is equal to the total heating load of the indoor units before change of the operation temperature, or when the recalculated total heating load is equal to the total cooling load of the indoor units before change of the operation temperature, and the outdoor unit carrying out cooling when the outdoor temperature exceeds the reference temperature, and the outdoor unit carrying out heating when the outdoor temperature is below the reference temperature.

* * * * *